US007234411B1

(12) United States Patent
Butler

(10) Patent No.: US 7,234,411 B1
(45) Date of Patent: Jun. 26, 2007

(54) HELMET FLAG

(76) Inventor: Steven R. Butler, 6923 S. Running Springs Dr., West Jordan, UT (US) 84084

( * ) Notice: Subject to any disclaimer, the term of this patent is extended or adjusted under 35 U.S.C. 154(b) by 0 days.

(21) Appl. No.: 10/967,688

(22) Filed: Oct. 18, 2004

(51) Int. Cl.
*G09F 17/00* (2006.01)
*A42B 1/24* (2006.01)

(52) U.S. Cl. ..... 116/173; 116/29 R; 2/422; 2/209.13

(58) Field of Classification Search ..... 116/173, 116/174, 175, 28 R; 40/591, 592, 608
See application file for complete search history.

(56) References Cited

U.S. PATENT DOCUMENTS 1,266,681 A * 5/1918 Harvie ..... 248/513
1,343,140 A * 6/1920 Keeley ..... 116/173
1,493,463 A * 5/1924 Brock ..... 2/7
2,433,940 A * 1/1948 Weaver ..... 232/35
2,652,649 A * 9/1953 Kobert ..... 40/303
3,104,644 A * 9/1963 Burton ..... 116/209
3,213,823 A * 10/1965 Levy et al. ..... 116/203
3,241,516 A * 3/1966 Hopkins ..... 116/173
3,482,543 A * 12/1969 Guidos ..... 232/35
3,825,214 A 7/1974 Ciolfi
3,968,928 A * 7/1976 Caldwell ..... 232/35
D244,236 S * 5/1977 Kyle ..... D29/122
4,164,087 A * 8/1979 Crownover ..... 40/492
4,372,481 A * 2/1983 Benson ..... 232/34
4,521,831 A * 6/1985 Thayer ..... 362/570
4,561,301 A * 12/1985 Steele ..... 73/170.05
4,599,965 A * 7/1986 Johnson ..... 116/209
4,697,733 A * 10/1987 Todd ..... 232/34
4,728,028 A * 3/1988 Barnes et al. ..... 232/35
4,905,406 A * 3/1990 Warner ..... 43/107
4,998,187 A * 3/1991 Herrick ..... 362/103
5,027,992 A * 7/1991 Murray, III ..... 224/181
5,123,590 A * 6/1992 Teele ..... 232/35
5,383,633 A * 1/1995 Ellestad ..... 248/160
5,438,494 A * 8/1995 Harlan ..... 362/106
5,462,471 A * 10/1995 Power-Fardy ..... 446/26
5,530,970 A * 7/1996 Knutson ..... 2/209.13
5,881,391 A 3/1999 Mullaney
5,964,401 A * 10/1999 Thill ..... 232/35
6,457,838 B1 * 10/2002 Dugmore et al. ..... 362/106
6,616,294 B1 9/2003 Henry
6,874,167 B1 * 4/2005 Leszczynski ..... 2/209.13
7,114,198 B1 * 10/2006 Hsieh et al. ..... 2/422
2003/0084835 A1 * 5/2003 Chao ..... 116/173
2004/0006900 A1 * 1/2004 Beller ..... 40/329
2006/0021117 A1 * 2/2006 Madonia ..... 2/422

FOREIGN PATENT DOCUMENTS

FR 2760328 A1 * 9/1998

* cited by examiner

*Primary Examiner*—Richard Smith
*Assistant Examiner*—Amy R. Cohen
(74) *Attorney, Agent, or Firm*—Crossley Patent Law; Mark A. Crossley

(57) ABSTRACT

A helmet flag for providing added visibility and therefore safety to a rider of virtually any form of transportation that exposes a rider to view. The flag is preferably mounted to the rear of a helmet and is substantially removable. The flexible, interchangeable flag rod is partially comprised of a spring to further insure against breakage. Flags are interchangeable with respect to size, colors, and designs.

6 Claims, 4 Drawing Sheets

HELMET FLAG

BACKGROUND OF THE INVENTION

1. Field of the Invention

The invention relates to headwear and more specifically to a helmet flag for attaching to a helmet.

2. Description of the Prior Art

Prior art teaches various forms of helmet and vehicle adornments. By way of example:

U.S. Pat. No. 3,825,214 issued to Ciolfi on Jul. 23, 1974 discloses a flag holder which includes optional means for a quick release attachment, the attachment for connecting to the rear axle of a bicycle.

U.S. Pat. No. 6,616,294 B1 issued to Henry on Sep. 9, 2003 discloses a flashlight holder for use with a conventional hard hat.

U.S. Pat. No. 5,881,391 issued to Mullaney on Mar. 16, 1999 discloses a pair of small flags bearing a sports team's logo. The flags are designed to slip onto the brim of a baseball type cap.

While the above-described devices fulfill their respective and particular objects and requirements, they do not describe a helmet flag that provides for the advantages of the present invention; therefore, a need exists for an improved helmet flag. The present invention substantially departs from the conventional concepts and designs of the prior art.

SUMMARY OF THE INVENTION

In view of the foregoing disadvantages inherent in the known types of headgear attachments now present in the prior art, the helmet flag overcomes the above-mentioned disadvantages and drawbacks or the prior art.

As such, the general purpose of the helmet flag, described subsequently in greater detail, is to provide a helmet flag which has all of the advantages of the prior art mentioned heretofore and many novel features that result in an improved helmet flag which is not anticipated, rendered obvious, suggested, or even implied by the prior art, either alone or in combination thereof.

To accomplish this the helmet flag is comprised of a mounting plate for mounting to a helmet. The plate is universal, such that virtually any helmet offering protection to a user can be fitted with the helmet flag. Motorcyclists, skate boarders, in-line skaters, bicyclists, and roller bladders are but a few of the potential users of the helmet flat. Preferably, the flag is about 2 feet in length. When worn on the helmet, the flags uppermost signal is thereby far above a rider, offering visibility to those who might not normally see a helmet or a rider. Further, the helmet flag offers much greater safety than any sort of flag or device on a vehicle, as the helmet flag stays on a user, not on the vehicle. For example, should a motorcyclist dismount his cycle he is still visible. As the wearer is the primary concern in safety, and not the vehicle, the helmet flag is superior to other forms of banners or the like that attach to a vehicle, no matter the mode of transportation. As motorcyclists often ride in sand dunes, gullies, and over hilltops, they are difficult to see by others perhaps approaching from an opposite side of a visual obstruction. The helmet flag greatly enhances visibility of a rider. This same concept remains true for a bicyclist in traffic, a child in a parking lot, a child on a sidewalk, or any other imaginable scenario in which heightened visibility is advantageous.

Further, the helmet flag preferably removably attaches to a helmet. Using semi-permanent adhesive, the mounting plate is first attached to a helmet, preferably with a double-sided rubber-centered adhesive strip. Such materials are common in the art of fastening and typically include a peel off protective strip for shielding the adhesive properties until a user has chosen an application. Once applied, preferably to the lower rear of a typical helmet, the mounting plate then removably accepts the attachment plate. The attachment plate is, in the preferred embodiment, affixed to the mounting plate with typical fasteners, such as small screws. An alternate embodiment utilizes an interference fit common to removable, vertical insertions. Still a more basic embodiment does not offer a removable attachment plate but attaches the attachment horizontal directly to the mounting plate. The mounting plate is designed with variations in size and shape, with the preferred embodiment resembling a Maltese cross. This embodiment provides for the mounting plate to flex into the desired curvature of various helmet sizes and shapes.

The attachment horizontal projects perpendicularly rearward from the attachment plate and offers a horizontal plane with threaded hole for removable attachment of the rod. The insert of the rod is threaded, at the lower extremity, for insertion into the horizontal. Once the insert threads are firmly abutted, a nut is used to further secure the flags insertion. Removability remains, though, to provide for rod removal or replacement. On the rod, directly above the insert is an affixed spring of a diameter only slightly larger than the rod. The spring extends upwardly for only a few inches.

Preferably about two inches of spring are utilized. Various embodiments are not limited to spring height, though. The flag's rod extends above the spring to a removable cap. The preferred embodiment of the helmet flag provides a flag height about 2 feet above the mounting plate. Other embodiments provide a longer flag for use with helmets and also for use with vehicles. The helmet flag is not restricted to helmet use only, and offers advantages over other forms of vehicle identification currently in use.

Below the removal rod cap, the rod is centrally hollow for a few inches. Tangential to the hollow is a flag slot. The hollow accepts the belly of a flag. The belly is formed by the sewn fold of the flag. In another embodiment, the belly is further enhanced with the addition of a material to enlarge the belly, thereby providing secure fit within the hollow. As example, with the embodiment of the invention utilizing a plastic flag, the belly is an enlarged part of the molded plastic. The flag exits the rod through the flag slot. Flags are preferably a few inches high and long, but are not limited in shape or size. Easy removal of the flag is an important feature of the helmet flag. Various colors of flags can be used. Further, the flags can contain advertising messages, logos, or colors of various companies wanting greater notoriety in a sport. X-game pursuits with bicyclers, skaters, and skateboarders are only a few examples. A further example includes the use of team colors in motorcycle racing events, especially dirt races.

The spring feature of the helmet flag is extremely important in that falls, collisions with others, collisions with obstacles, or the like are not likely to break the flag. Further, the rod is also of flexible material to further insure against flag breakage. The helmet flag is far superior to currently marketed whip flags that typically attach to a vehicle only and that are prone to breakage due to lack of flexibility.

The helmet flag is preferably made of a combination of plastics and metals, with several construction variations being practical. The mounting plate, for example, is typically made of plastic or metal, but also of composites, in further embodiments. The rod is selectively made of fiberglass, wood, plastic, or composite. Various uses of the helmet flag dictate production variations. While high speed motorcycle racing may call for lightweight, strong composites, a child's tricycle helmet is more economically viable when made of plastic parts. Typically, the flag itself is made of plastic or of woven material. The helmet flag is lightweight, flexible, inexpensive, easy to install, and offers much greater visibility to virtually anyone utilizing open transportation of any form. A rider's safety, whether in urban or rural areas, is greatly enhanced from the visibility offered by the helmet flag.

Thus has been broadly outlined the more important features of the helmet flag so that the detailed description thereof that follows may be better understood and in order that the present contribution to the art may be better appreciated. Numerous objects, features and advantages of the helmet flag will be readily apparent to those of ordinary skill in the art upon reading the following detailed description of presently preferred, but nonetheless illustrative, embodiments of the helmet flag when taken in conjunction with the accompanying drawings. In this respect, before explaining the current embodiments of the helmet flag in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the helmet flag. It is therefore important that the claims be regarded as including such equivalent constructions insofar as they do not depart from the spirit and scope of the present invention.

A primary object, then, of the helmet flag is to be flexible.

A further object of the helmet flag is to provide for removable attachment of all or substantially all of the device, with respect to a helmet.

Additionally, it is an object of the helmet flag to provide added safety for those on most any form of exposed transportation.

These together with additional objects of the helmet flag, along with various novel features that characterize the invention are particularly pointed out in the claims forming a part of this disclosure. For better understanding of the helmet flag, its operating advantages and specific objects attained by its uses, refer to the accompanying drawings and description.

DETAILED DESCRIPTION OF THE PREFERRED EMBODIMENT

With reference now to the drawings, and in particular FIGS. 1–4 thereof, the preferred embodiment of the helmet flag employing the principles and concepts of the present invention and generally designated by the reference number 10 will be described.

Figure 1:
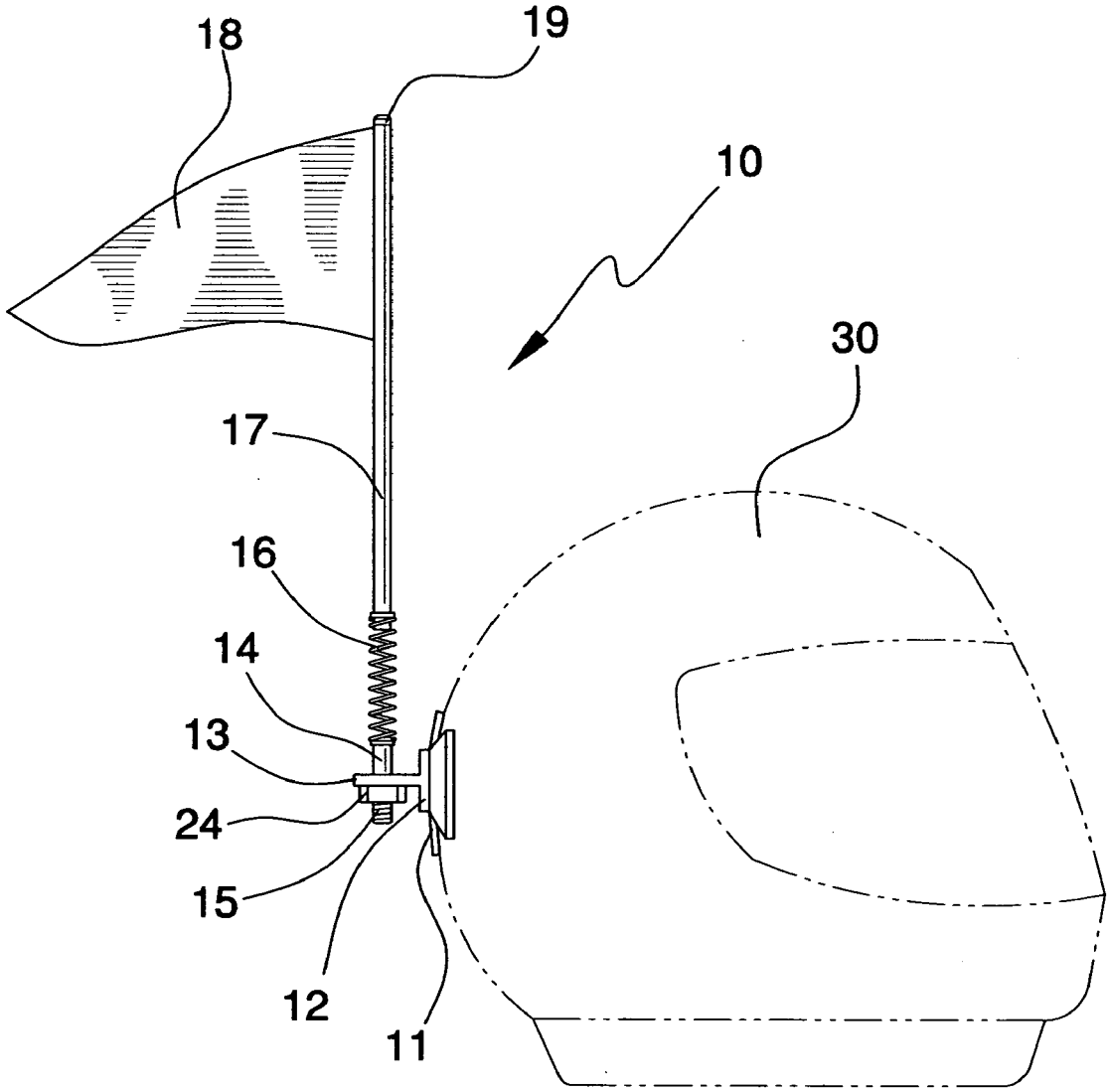
FIG. 1 is a lateral view of the helmet flag.
Figure 2:
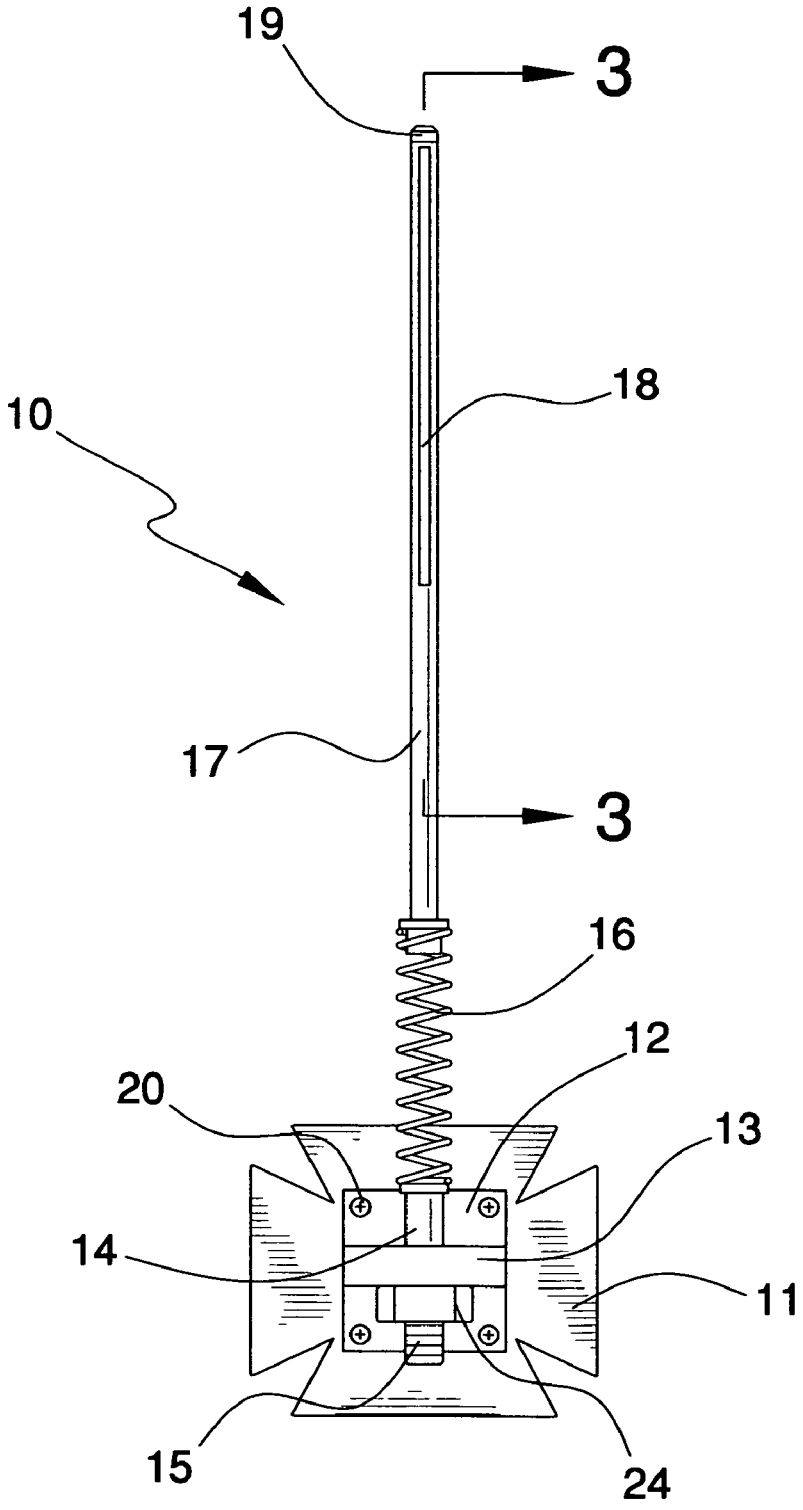
FIG. 2 is a rear view of the helmet flag.

Referring to FIG. 1, helmet flag device 10 for attaching to a helmet comprises a Maltese cross shaped mounting plate 11 for attaching to a rear of a typical protective helmet 30. Mounting plate 11 is flexed slightly inwardly concave to match the shape of a typical helmet 30. A substantially rectangular attachment plate 12 is removably attached to plate 11 (FIG. 2). Typical fasteners 20 provide removable attachment. An attachment horizontal 13 is perpendicularly affixed to plate 12. Horizontal 13 has, in the center, a vertical hole (not shown) for receiving insert 14. The hole is threaded. The lower end of insert 14 is further comprised of insert threads 15 for threaded entry of insert 14 into horizontal 13. Nut 24 further removably secures insert 14.

Figure 3:
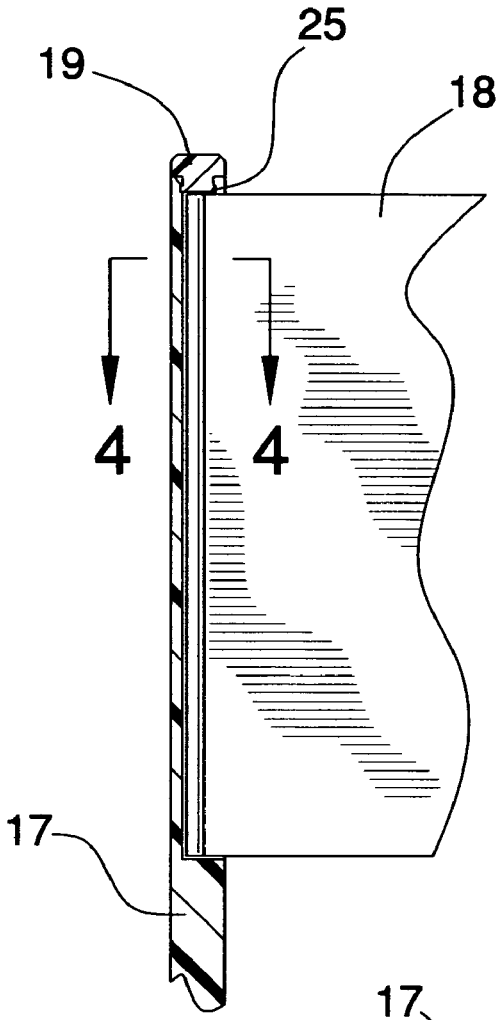
FIG. 3 is a lateral cross sectional view of the upper end of the helmet flag rod and flag.

Spring 16 is fixedly attached to the upper part of insert 14. Spring 16 extends upwardly for a few inches where it is fixedly attached to flexible rod 17. Referring to FIG. 3, the upper end of rod 17 further comprises a cap receiver 25. Receiver 25 provides interference fit for removable reception of cap 19. For about a few inches below cap 19, rod 17 further comprises, longitudinally within rod 17, flag hollow 22 and flag slot 23.

Figure 4:
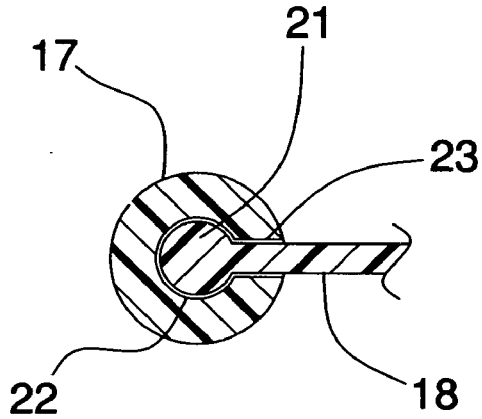
FIG. 4 is a top cross sectional view of the flag within the flag hollow and flag slot of the rod.
Figure 5:
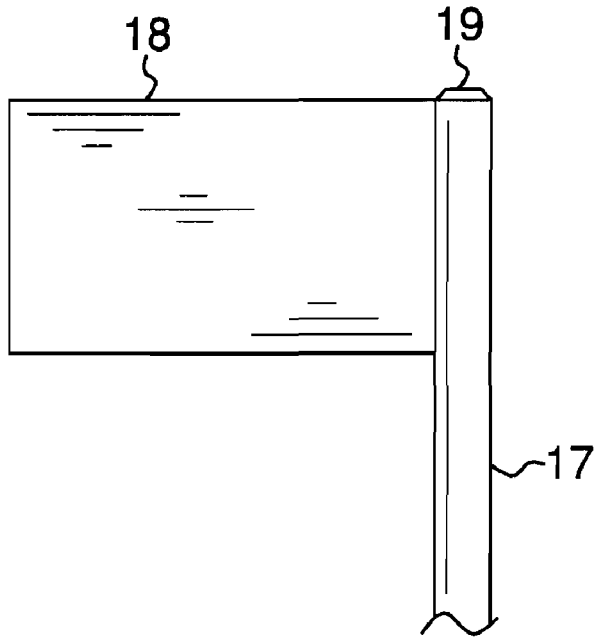
FIG. 5 is a side elevation view of an alternate shape embodiment of the flag.
Figure 6:
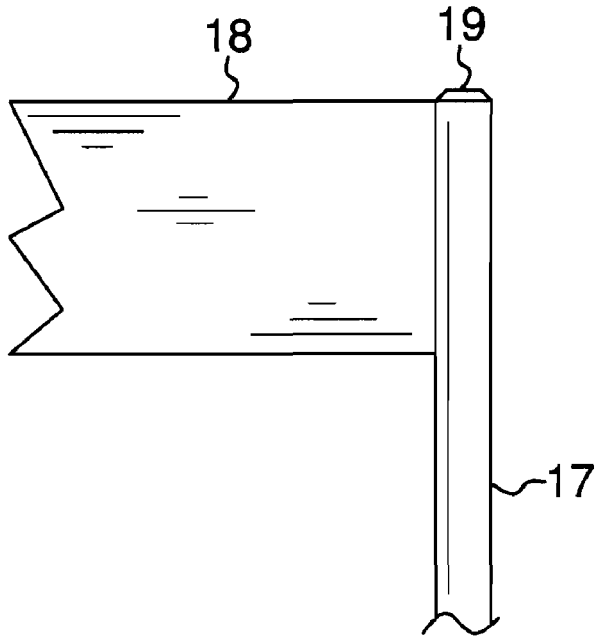
FIG. 6 is a side elevation view of an alternate shape embodiment of the flag.

Referring to FIG. 4, hollow 22 and slot 23 comprise a receptacle for flag 18. Flag belly 21 fits within hollow 22, with flag 18 sliding within flag slot 23. The majority of flag 18 is therefore free to wave, while being securely held to and partially within rod 17.

In use, adhesive film covering (not shown) of mounting plate 11 is removed. Flexible adhesive on plate 11 is typical in the art of semi-permanent adhesives. Plate 11 is stuck to the rear of a typical helmet, in the position desired. Attachment plate 12 is then fastened to plate 11 via typical fasteners 20. Insert 14 is then threaded with insert threads 15 into attachment horizontal 13. Threads are abutted for a snug fit. Nut 24 is then tightened onto threads 15 to further secure insert 14 to horizontal 13. Changing attachment plate 12 is a basic reversal of the installation steps. Changing of rod 17 is a basic reversal of insert thread and nut removal, opposite installation.

For change of flag 18, cap 19 is removed. Flag 18 is then slid out of hollow 22 and slot 23. Another flag 19 is inserted, with flag belly fitting into flag hollow 22 appropriately. Cap 19 is re-installed.

With respect to the above description then, it is to be realized that the optimum dimensional relationships for the parts of the helmet flag, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A helmet flag for attaching to a helmet, the helmet flag comprising:

a mounting plate removably attached to the helmet, the mounting plate substantially in the shape of a Maltese cross for conforming to a curvature of the helmet, the mounting plate attached to an approximately vertically oriented helmet portion;

a substantially rectangular attachment plate removably and vertically attached to the mounting plate;

a plurality of fasteners for attaching the attachment plate to the mounting plate;

an attachment horizontal extended perpendicularly from the attachment plate;

a vertically disposed insert, the insert having an upper end and a lower threaded end, the threaded end removably and vertically attached within the attachment horizontal;

a vertically disposed spring, the spring having an upper end, a lower end, and a length therebetween, the lower end attached around the upper end of the insert;

a vertically disposed flexible rod, the flexible rod having an upper end and a lower end, the lower end of the flexible rod affixed within the upper end of the spring;

a flag removably affixed within the upper end of the rod;

a cap on the upper end of the rod.

2. The helmet flag in claim 1 wherein the flag is provided in a plurality of designs.

3. The helmet flag in claim 2 wherein the flag is provided in a plurality of shapes.

4. The helmet flag in claim 3 wherein the cap is a removable cap, the cap removably capturing the flag.

5. The helmet flag in claim 4 wherein the rod further comprises a flag hollow and flag slot at the upper end of the rod and extending longitudinally downward therefrom, the hollow and slot accessed by removal of the cap, the cap, hollow and slot removably receiving the flag and a belly of the flag.

6. A helmet flag for a helmet, comprising, in combination:

a mounting plate removably attached to the helmet, the mounting plate capable of conforming to a curvature of the helmet, the mounting plate for attachment to an approximately vertically oriented helmet portion;

an attachment plate for generally vertical removable attachment to the mounting plate;

a horizontal attachment plate extended perpendicularly from the attachment plate;

an insert, the insert having an upper end and a lower threaded end, the threaded end removably and vertically attached to the horizontal attachment plate;

a spring attached to the upper end of the insert;

a flexible rod, the flexible rod having an upper end and a lower end, the lower end affixed to the spring;

a flag removably affixed within the upper end of the rod;

a cap on the upper end of the rod.

* * * * *